US009038975B2

(12) United States Patent
Brownlee

(10) Patent No.: US 9,038,975 B2
(45) Date of Patent: May 26, 2015

(54) FLORAL VASE ANCHOR

(71) Applicant: Richard William Brownlee, Spartanburg, SC (US)

(72) Inventor: Richard William Brownlee, Spartanburg, SC (US)

( * ) Notice: Subject to any disclaimer, the term of this patent is extended or adjusted under 35 U.S.C. 154(b) by 0 days.

(21) Appl. No.: 13/771,590

(22) Filed: Feb. 20, 2013

(65) Prior Publication Data

US 2014/0231596 A1 Aug. 21, 2014

(51) Int. Cl.

| | |
|---|---|
| ***A47G 7/00*** | (2006.01) |
| ***A47G 7/02*** | (2006.01) |
| ***A47G 7/06*** | (2006.01) |
| ***A47G 7/07*** | (2006.01) |
| ***E04H 13/00*** | (2006.01) |

(52) U.S. Cl.
CPC *A47G 7/025* (2013.01); *A47G 7/00* (2013.01); *A47G 7/06* (2013.01); *A47G 7/07* (2013.01); *E04H 13/001* (2013.01)

(58) Field of Classification Search
CPC ..... A47F 5/01
USPC ..... 248/27.8, 551, 121, 146, 148, 200
See application file for complete search history.

(56) References Cited

U.S. PATENT DOCUMENTS

| | | | | | |
|---|---|---|---|---|---|
| 2,389,447 | A | * | 11/1945 | Meadows | 47/41.12 |
| D159,658 | S | * | 8/1950 | McCallum | 11/146 |
| 3,297,289 | A | * | 1/1967 | La Raus | 248/152 |
| 3,386,693 | A | * | 6/1968 | Ring | 248/27.8 |
| 3,477,669 | A | * | 11/1969 | Thompson et al. | 248/27.8 |
| 3,962,826 | A | * | 6/1976 | Kienlen et al. | 47/41.13 |
| 4,203,180 | A | * | 5/1980 | Striplin | 24/17 B |
| 4,621,733 | A | * | 11/1986 | Harris | 206/423 |
| 5,375,370 | A | * | 12/1994 | Zimmerman | 47/41.01 |
| 5,380,568 | A | * | 1/1995 | Banschick | 428/4 |
| 5,645,168 | A | * | 7/1997 | Honkawa | 206/423 |
| 6,018,908 | A | * | 2/2000 | Charrin et al. | 47/41.01 |
| 6,653,558 | B1 | * | 11/2003 | Bucher et al. | 174/50 |
| 7,641,156 | B2 | * | 1/2010 | Medders et al. | 248/125.8 |
| 7,721,888 | B2 | * | 5/2010 | Elfezouaty | 206/423 |
| 7,774,977 | B2 | * | 8/2010 | Miller Shelton | 47/45 |
| 8,096,416 | B2 | * | 1/2012 | de Pagter et al. | 206/423 |
| 8,201,783 | B1 | * | 6/2012 | Bamburg, Jr. | 248/150 |
| 2002/0153457 | A1 | * | 10/2002 | Cumby | 248/27.8 |
| 2003/0089033 | A1 | * | 5/2003 | Wimp, Jr. | 47/41.11 |
| 2008/0230409 | A1 | * | 9/2008 | Elfezouaty | 206/223 |
| 2010/0044523 | A1 | | 2/2010 | Collins et al. | |
| 2011/0272534 | A1 | * | 11/2011 | Rosenberg | 248/27.8 |

* cited by examiner

*Primary Examiner* — Monica Millner
(74) *Attorney, Agent, or Firm* — Southeast IP Group, LLC; Thomas L. Moses

(57) ABSTRACT

The floral vase anchor is preferably formed from a single strip of plastic or metal, and includes a tri-planar surface, wherein the central portion includes a series of notches on either side, and upper and lower sections extend at obtuse angles away from the plane of the central portion. The upper section and lower section each include floral insert slots at the distal ends thereof for receiving the stems from a floral arrangement. In use, a florist may insert the stems into the floral insert slots until the stems are positioned within the rounded portion of the slots. Then rubber bands may be used to secure the stems to the anchor, and the assembly may be placed into a vase. A securing mechanism may be used to fix the anchor to the vase, and may also be used to secure the vase to the ground or a monument.

9 Claims, 7 Drawing Sheets

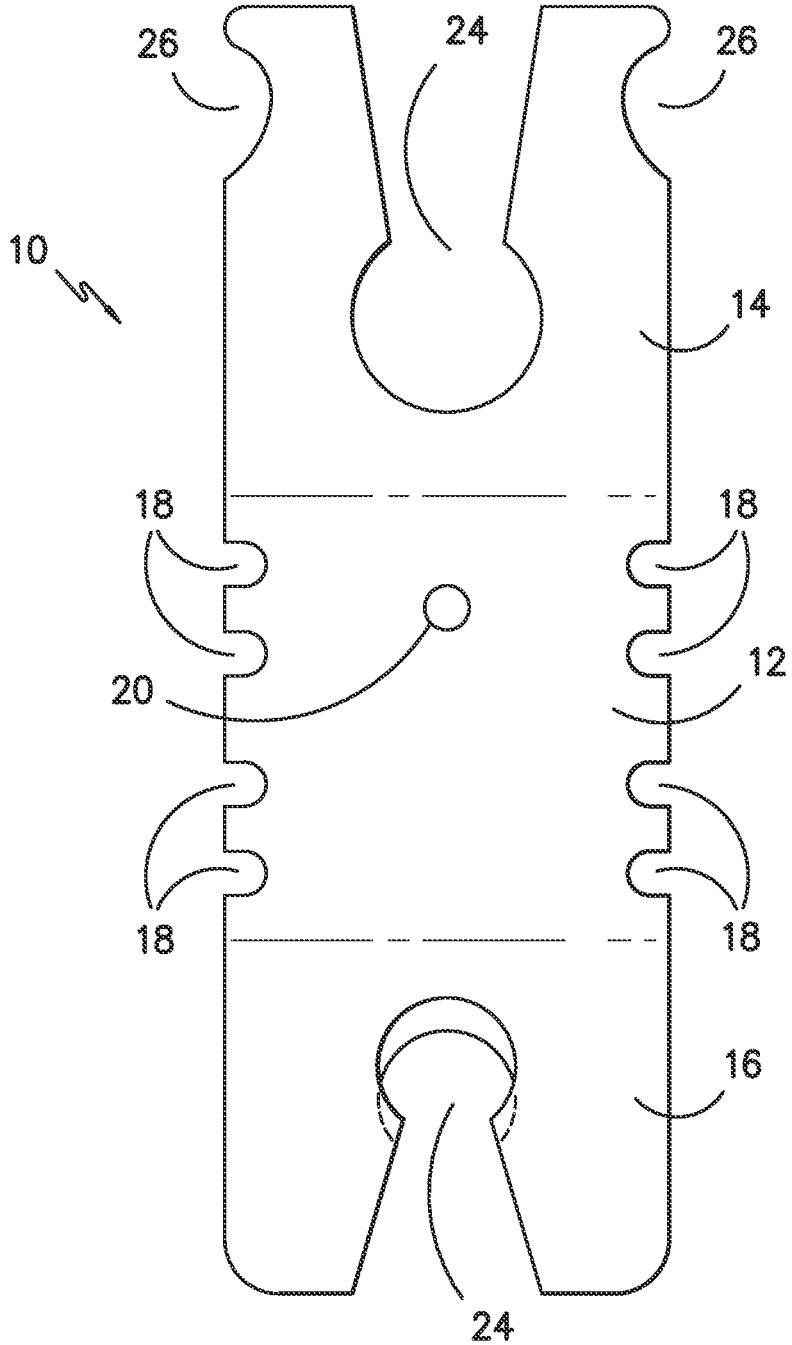
FIG. —1—

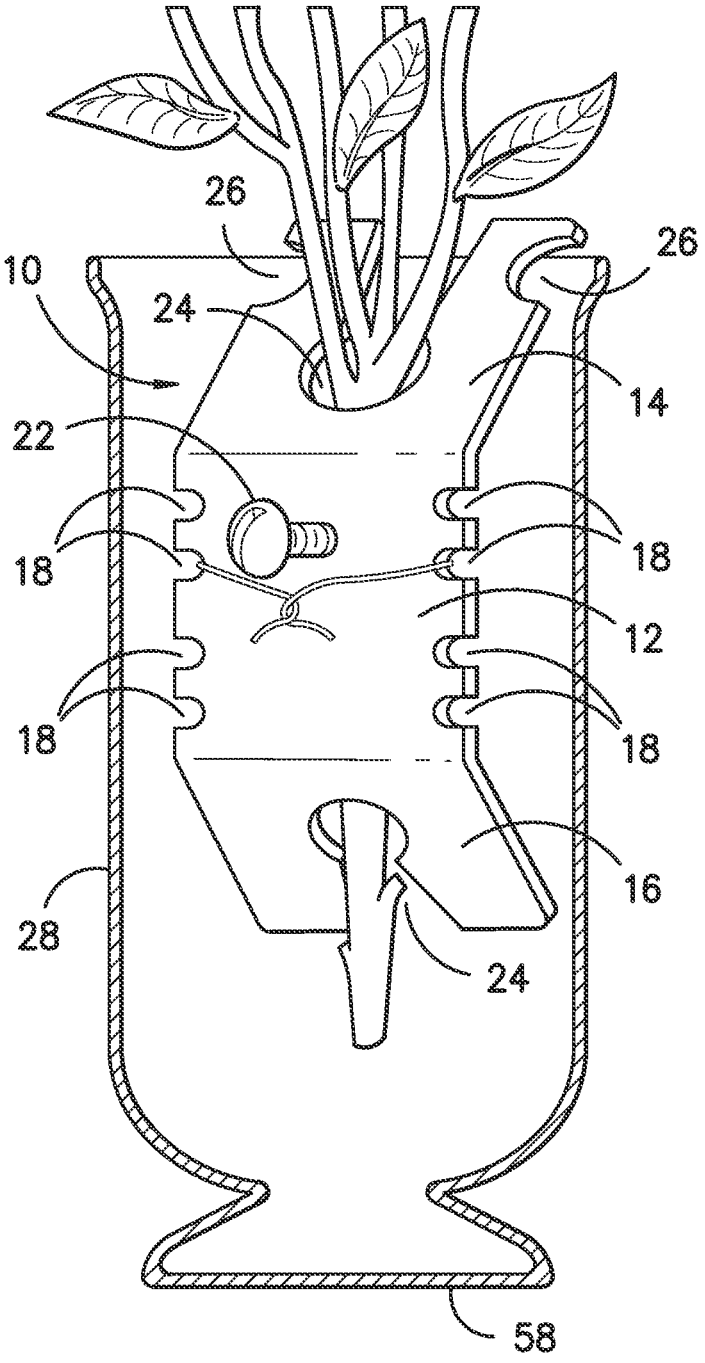
FIG. —2—

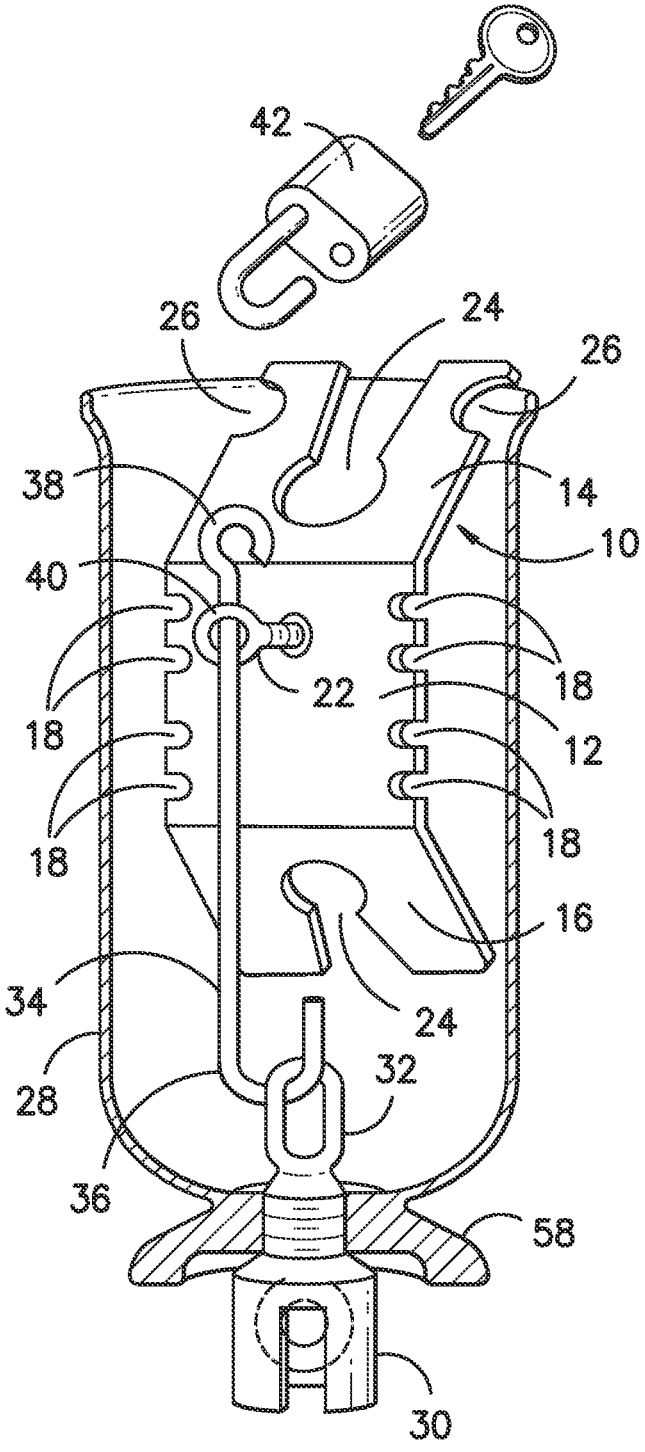
FIG. —3—

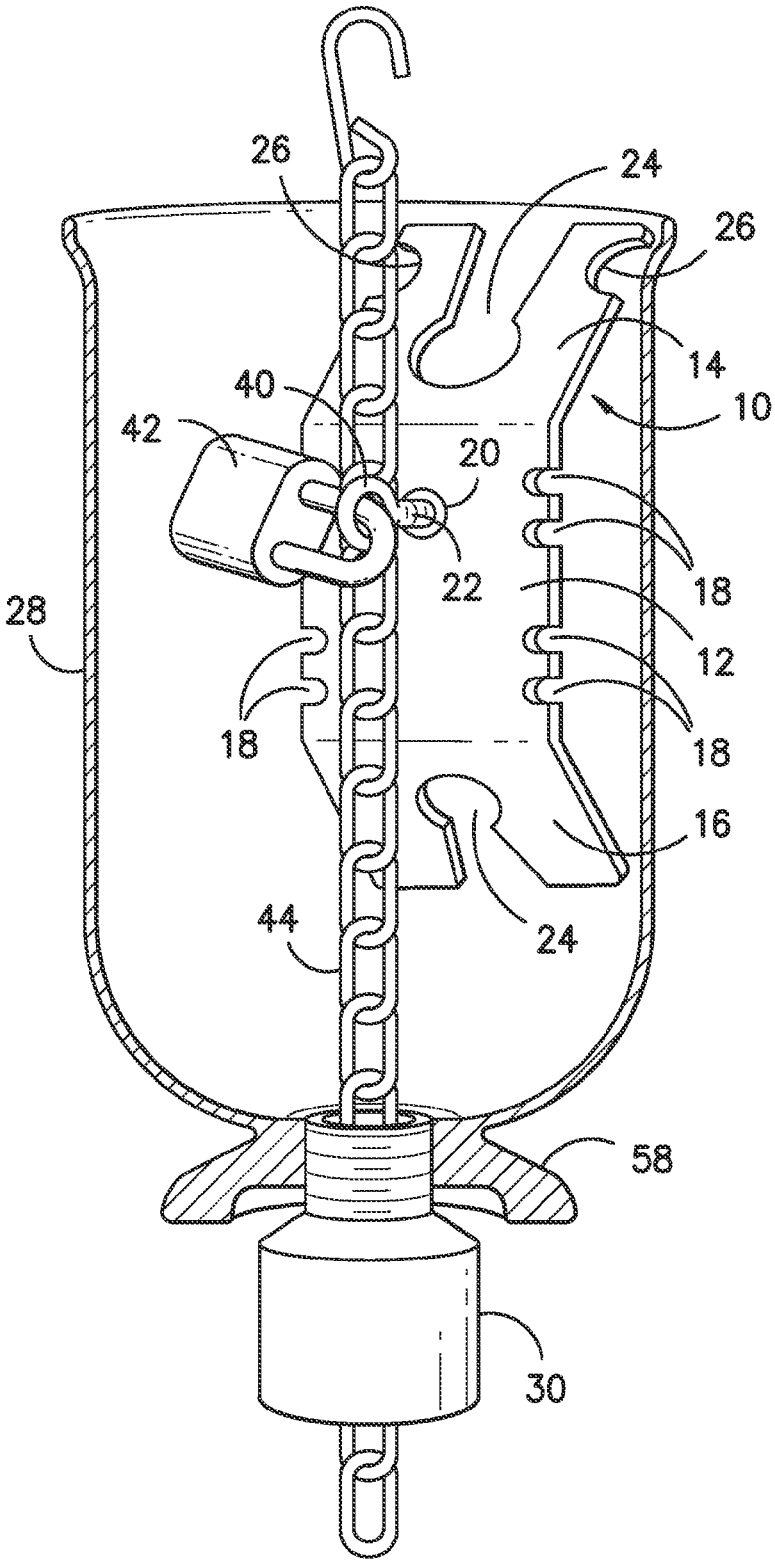
FIG. —4—

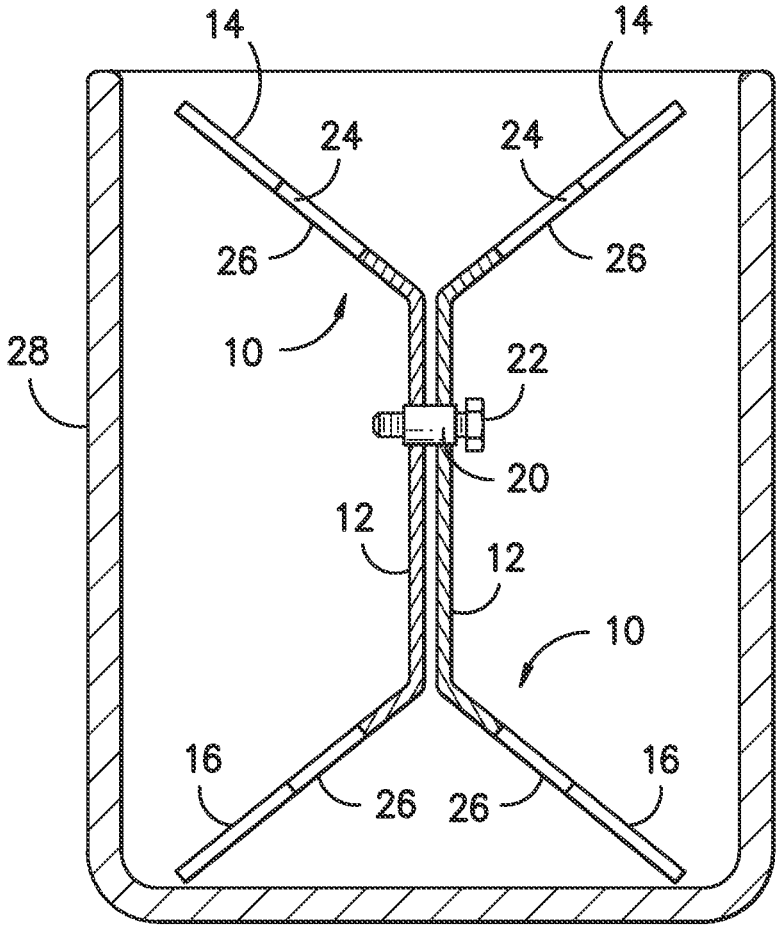
FIG. —5—

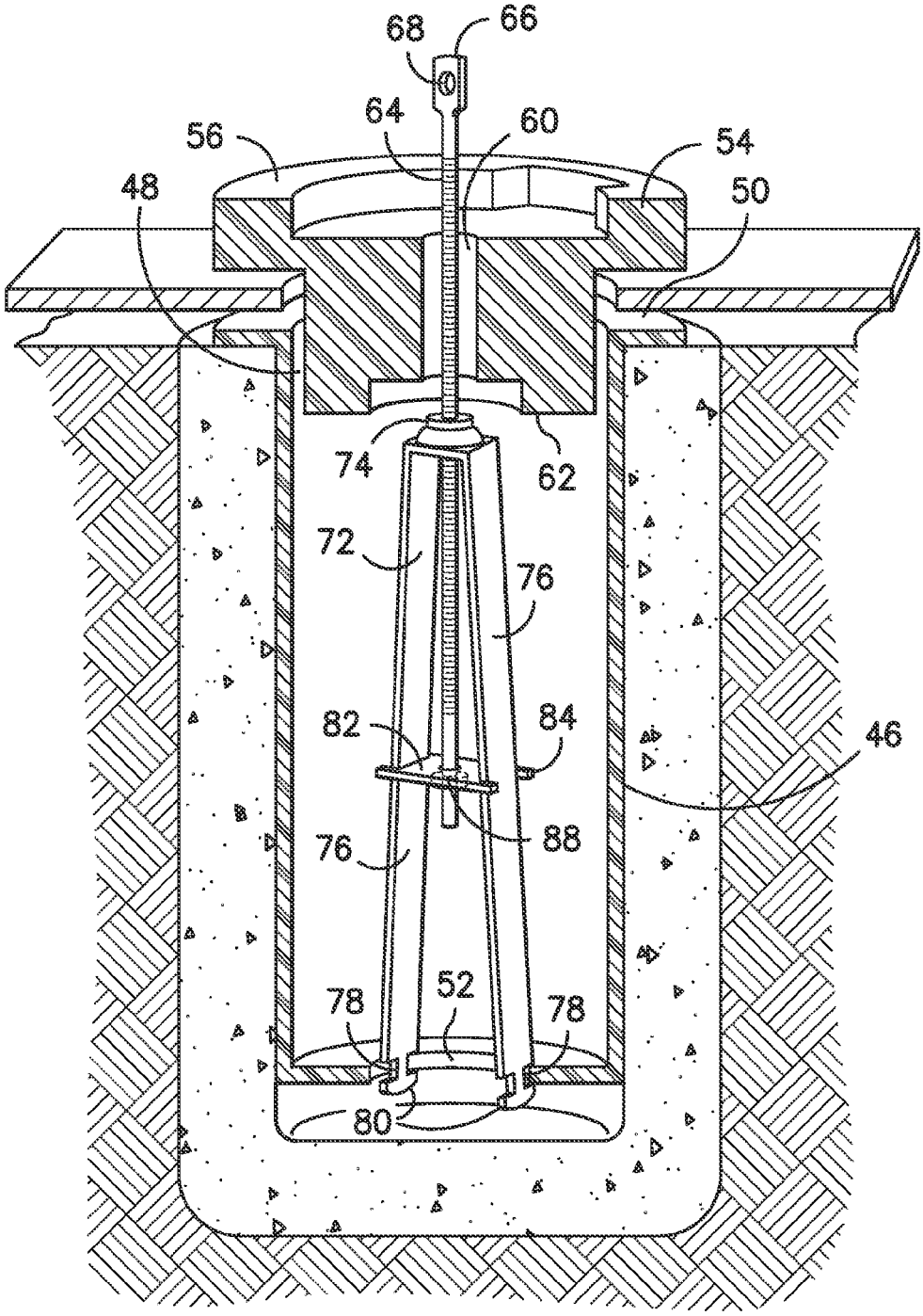
FIG. —6—

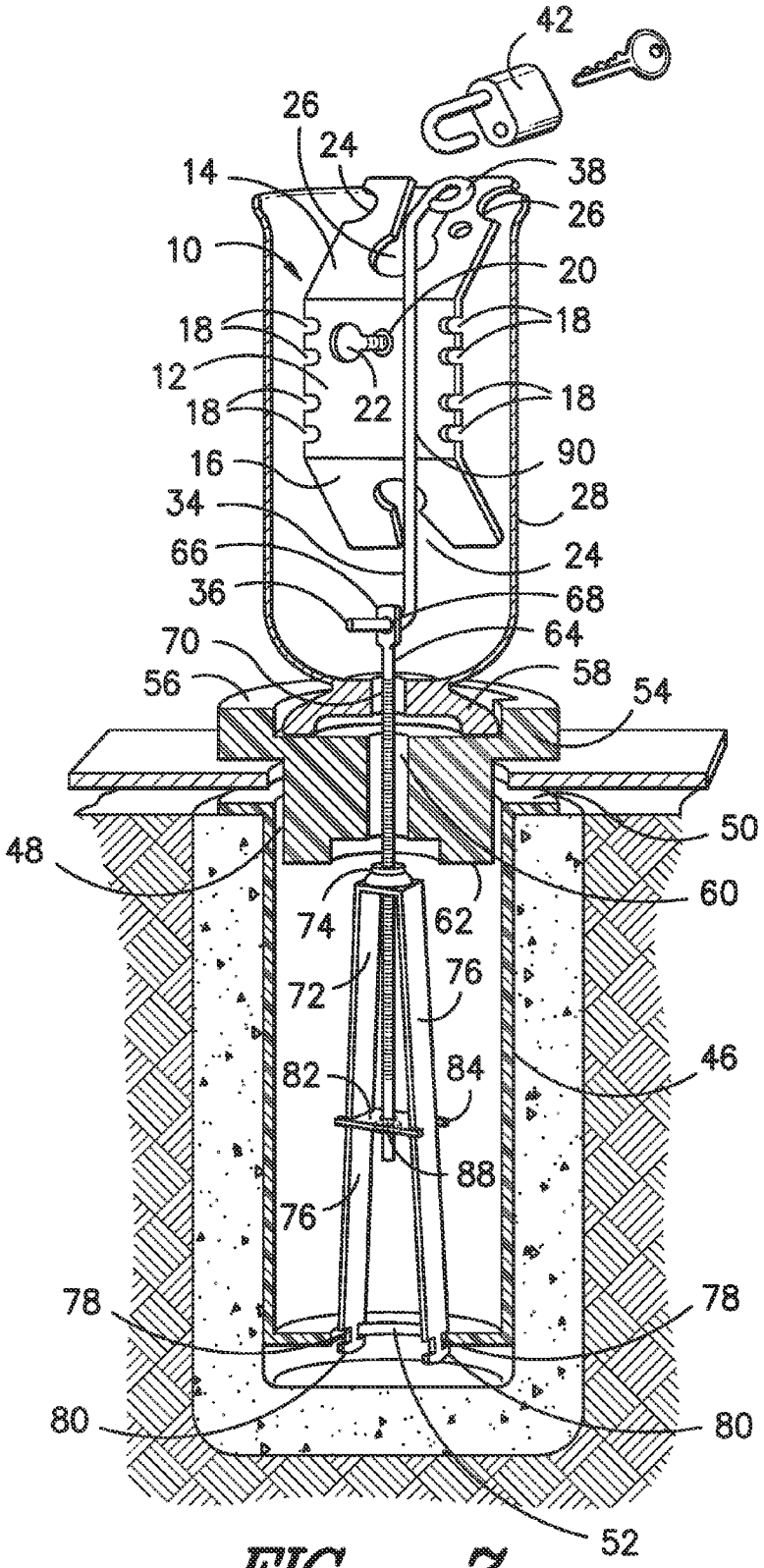
FIG. —7—

FLORAL VASE ANCHOR

BACKGROUND OF THE INVENTION

The present invention relates generally to floral vase accessories. More specifically, the present invention includes a floral vase anchor that is used to secure a floral arrangement or the like within a vase, particularly for use in outdoor environments such as cemeteries and memorials.

Heretofore, many different commercial products have been developed for securing floral arrangements in vases and other types of decorative floral containers. One well-known product is made from a type of Styrofoam, wherein the stems of the floral arrangement are inserted into the Styrofoam block, which is then placed into a vase or other decorative container.

However, there are several significant problems associated with these types of Styrofoam floral holders. First, Styrofoam is not an environmentally friendly composition, thus creating a need for a different type of floral arrangement anchor that has less of a negative environmental impact. Secondly, working with Styrofoam is messy, as the act of inserting the stems into the Styrofoam block tends to produce Styrofoam crumbs and debris, which accumulates on the working surfaces and floor of a florist's shop and work space. Further, the Styrofoam blocks tend to degrade and crumble over time, which not only creates additional environmental issues, but also means that they must be replaced periodically, and the degradation process tends to be accelerated when the arrangement is placed outdoors for long periods of time.

Another issue with these types of Styrofoam floral holders, particularly relating to outdoor use, is that when it rains, the water collects in the vase or decorative container, and the Styrofoam block tends to float upwardly toward the top of the vase. If the vase fills with water, the Styrofoam block floats to the top, and the arrangement becomes top heavy and often falls out of the vase, particularly if a brisk breeze is blowing.

Other floral anchoring products have been developed, as well. U.S. Patent Application Publication No. 2010/0044523 is directed to a floral latch that includes a metal collar that fits around an upper portion of a vase, and further includes an adjustable cord that stretches over the top of the vase, through the flower arrangement, and attaches to the collar on both ends. One issue associated with this device is that it is visible while in use, and creates an unsightly distraction from the vase and floral arrangement. Additionally, this device holds the floral arrangement in the vase only loosely, with a lot of opportunity for the floral arrangement to shift positions and become dislodged from the optimal position within the vase.

Thus, it would be desirable to provide a floral vase anchor that is simple and inexpensive to manufacture, and which would avoid some of the technical and environmental problems associated with other types of floral anchors that have been developed and used to date.

BRIEF SUMMARY OF THE INVENTION

In accordance with one aspect of the invention, a floral vase anchor is formed, in a preferred embodiment, of singular monolithic (one-piece) construction. The floral vase anchor is preferably formed from a single strip of plastic or metal, and includes a tri-planar surface, wherein the central portion includes a series of notches on either side, and at each longitudinal end of the central portion, upper and lower sections extend at obtuse angles away from the plane of the central portion. The upper section and lower section each include floral insert slots at the distal ends thereof for receiving the stems from a floral arrangement. The slots preferably are wider at the mouth, and become more narrow toward the center of the upper and lower sections, culminating in a rounded portion where the floral arrangement stems are ultimately secured. In a preferred embodiment, the upper section may include rounded indentations on either side adjacent the mouth of the floral insert slot, and these indentations may be used to engage the upper mouth of the vase, so that the floral vase anchor may be more securely positioned within the vase.

In one embodiment, a tension screw may be positioned within a threaded hole in the central portion of the floral vase anchor. The central screw may be screwed inwardly our outwardly, and typically would be used to create a secure fit for the floral anchor within the vase.

In use, a florist may insert the stems into the floral insert slots until the stems are positioned within the rounded portion of the slots. Then rubber bands, or the like, may be wrapped around the central floral vase anchor and the inserted stems, and the rubber bands may be secured to one or more of the notches positioned on the side of the central portion. Then, the floral anchor and floral arrangement are placed into a vase, and the tension screw may be extended outwardly until it comes into contact with the inner surface of the vase, in order to provide a tight, secure fit for the entire arrangement within the vase.

A securing mechanism may be employed as well, to secure the floral anchor to the vase, and may also be used to secure the entire assembly to the ground or to a preformed monument, or the like.

BRIEF DESCRIPTION OF THE DRAWINGS

These and other features, aspects, and advantages of the present invention will become better understood with regard to the following description, appended claims, and accompanying drawings where:

FIG. 1 shows a front view of a floral vase anchor in accordance with one embodiment of the present invention;

FIG. 2 shows a cut-away side view of a floral vase anchor positioned within a vase with a floral arrangement attached thereto;

FIG. 3 shows a cut-away side view of a floral vase anchor positioned within a vase, and further showing a locking mechanism for securing the floral vase anchor to the vase;

FIG. 4 shows a cut-away side view of a floral vase anchor positioned within a vase, and further showing another embodiment of a locking mechanism for securing the floral vase anchor to the vase;

FIG. 5 shows a cut-away side view of a pair of floral vase anchors attached together and positioned within a vase;

FIG. 6 shows a cut-away side view of a securing mechanism for securing a floral vase anchor within a vase, and which also secures a vase to the ground; and FIG. 7 shows a cut-away side view of a vase, a floral vase anchor positioned within the vase, and a securing mechanism for securing the floral vase anchor within the vase, and which also secures the vase to the ground.

DETAILED DESCRIPTION OF THE INVENTION

The present invention includes, in a first embodiment, a floral vase anchor 10, as shown in FIG. 1. The floral vase anchor 10, in a preferred embodiment, includes a monolithic strip of a generally rigid material, which is bent into three planes. The central portion 12 is attached at an upper end to an upper portion 14, which is bent at an obtuse angle away from the plane of the central portion 12. A lower portion 16 is similarly attached to a lower end of the central portion 12, and the lower portion 16 is also bent away from the central plane at an obtuse angle, so that the floral vase anchor 10 is slightly C-shaped with straight planes.

In a preferred embodiment, both side edges of the central portion include a series of notches 18, and a threaded hole 20 is positioned on the central portion for receiving a tension screw 22. Both the upper 14 and lower portions 16 include floral insert slots 24 at the distal ends thereof for receiving the stems from a floral arrangement. The slots 24 preferably are wider at the mouth, and become narrower toward the center of the upper and lower sections, culminating in a rounded portion where the floral arrangement stems are ultimately secured.

In a preferred embodiment, the upper portion 14 may include rounded indentations 26 on either side, adjacent the mouth of the floral insert slot 24, and these indentations 26 may be used to engage the upper mouth of the vase 28, so that the floral vase anchor 10 may be more securely positioned within the vase 28.

In use, a florist may insert the stems of a natural or artificial flower arrangement through the floral insert slots 24, and then secure the stems to the floral vase anchor 10 with rubber bands (or twist ties, Velcro, or the like) by affixing the rubber bands to the notches 18 on the sides of the central portion 12. Then, the apparatus may be inserted into a vase 28 or decorative container, and the tension screw 22 may be adjusted so that it comes into contact with the inner surface of the vase 28. In this way, the floral vase anchor 10 may be tightly secured within the vase 28, as shown in FIG. 2.

FIGS. 3 and 4 illustrate the use of the floral vase anchor 10 together with securing mechanisms that are used to secure the floral vase anchor 10 to the vase 28 or decorative container. In FIG. 3, the vase 28 includes a threaded plug 30 in a bottom portion of the vase 28, and the plug 30 includes a securing ring 32 extending upwardly from the bottom of the vase 28. A hook member 34 includes a hook 36 at one end and an eyelet 38 at the other, and is used to connect the floral vase anchor 10 to the vase 28. The hook member 34 is used to engage the securing ring 32 at the bottom of the vase 28 on one end, and the eyelet 38 may be threaded through a loop 40 positioned on the tension screw 22, as shown. Then, a small lock 42 may be secured to the eyelet 38 and/or the loop 40 on the tension screw 22. When the hook member 34 is attached to the securing ring 32 and the tension screw loop 40, the floral vase anchor 10 is removably secured to the vase 28. A person may use a key to unlock the lock 42 and disengage the securing mechanism in order to remove the floral vase anchor 10 from the vase 28, but otherwise, the anchor 10 and vase 28 are secured together against high winds and inclement weather.

FIG. 4 shows an alternate embodiment of a securing mechanism, wherein a chain 44 is secured to the bottom of the vase 28, and a lock 42 is used to secure one link of the chain 44 to the loop 40 on the tension screw 22. It is contemplated that other types of securing mechanisms may be used to secure the anchor to the vase 28, together with a floral arrangement.

FIG. 5 shows the use of two floral vase anchors 10 secured together, preferably for use with larger vases 28 and larger floral arrangements. In this embodiment, two floral vase anchors 10 are positioned "back to back," and a single tension screw 22 is screwed through both threaded holes 20 in the respective central portions 12 of each floral vase anchor 10. In use, a florist may attach the two floral vase anchors 10 as described herein, then insert the floral arrangement into the floral insert slots 24 and secure them with rubber bands or other elastics. Once the arrangement is secured to the two floral vase anchors 10, the entire assembly may be placed into a large vase 28 or container. It is contemplated that the securing mechanisms described herein may also be used in this multiple-anchor embodiment.

FIG. 6 shows yet another securing mechanism that may be used to secure the floral vase anchor 10 to the vase 28, and also may be used to secure the vase 28 to a monument or to the ground. In a preferred embodiment, as shown, a vase insert 46 (which is preferably cylindrical in shape, but could form any other suitable shape) includes a mouth 48 at a top portion thereof, having a lip 50 extending outwardly around the top perimeter and a centrally disposed hole 52 in a bottom portion thereof. The cylindrical vase insert 46, which is preferably made from plastic, but could made from any suitable material, is inserted into a hole in the ground (or monument), wherein the hole extends slightly deeper than the bottom of the cylindrical vase insert 46. A rubber vase guard 54 is adapted to fit into the mouth 48 of the cylindrical vase insert 46, and includes a circular lip 56 to receive the base 58 of the vase 28, as well as a centrally disposed hole 60 extending axially therethrough. The bottom portion of the rubber vase guard 54 includes a downwardly extending lip 62 about the periphery thereof. A threaded post 64 includes a tab 66 at a top portion, wherein the tab 66 includes a hole 68 disposed in the center of the tab 66 in a vertical orientation. In use, the threaded post 64 extends downwardly through a hole 70 in the bottom of the vase 28, through the hole 60 in the rubber vase guard 54, and substantially down through the cylindrical vase insert 46. A two-legged securing tong 72 includes a threaded hole 74 at a top portion thereof, which engages the threaded post 64 within the cylindrical vase insert 46 by screwing the securing tong 72 onto the threaded post 64. The bottom of each leg 76 of the securing tong 72 includes a pair of indentations 78 on either side thereof. The tong legs 76 may be manually forced inwardly toward one another in order to fit the feet 80 into the hole 52 at the bottom of the cylindrical vase insert 46. When such force is released, the feet 80 are biased outwardly away from one another, and the indentations 78 adjacent the feet 80 may engage the perimeter of the hole 52 in the bottom of the cylindrical vase insert 46, as shown, in order to secure the securing tong 72 to the cylindrical vase insert 46. A generally square spacer 82 may include indentations 84 on each side to engage the legs 76, in order to further force the legs 76 outwardly so that a frictional engagement is maintained between the feet 80 and the hole in the bottom of the cylindrical vase insert 46. The spacer 82 may include a centrally disposed hole 88, through which the threaded post may pass.

A rod 90 is bent on one end to include a substantially 90 degree angle on a bottom end, and includes an angular bend toward a top end with a loop 92 at the top thereof. The bottom end of the rod 90 may be inserted through the hole 68 in tab 66 of the threaded post 64, and extends upwardly along the floral vase anchor 10. The angular portion of the rod 90 corresponds with the top angle of the floral vase anchor 10, and the loop 92 at the top of the rod 90 may be positioned adjacent a hole in the floral vase anchor 10, as shown, so that a lock 42 may be attached through the loop 92 and the hole in the floral vase anchor 10 in order to secure the entire mechanism together.

The entire assembly may be adjustable, so that the securing tong 72 may be threaded upwardly or downwardly along the threaded post 64, and the spacer 82 may be slid upwardly or downwardly between the legs 76 of the securing tong 72 in order to provide increased or decreased outward force on the legs 76. When the assembly is properly adjusted and secured, the vase 28 and the floral vase anchor 10 are secured to the ground in a flexible manner, so that the vase 28 may bend in any direction due to the flexibility of the rubber vase guard 54 when a force is applied thereto, but which will rebound to its original vertical position when the force is no longer applied.

In another embodiment, the securing mechanism includes a spike adapted to be securely driven into the ground (preferably a pigtail spike), a c-clamp with a closing mechanism (or other suitable attachment means) attached to the spike, a spring attached to the c-clamp, and a chain attached to the spring. The other end of the chain may be attached to the floral vase anchor 10, and is preferably locked in place with a small lock 42. In this embodiment, the vase 28 is adapted to be received by a rubber vase guard 54, which fits into a hole in the ground and provides support for the vase 28. The rubber vase guard 54 preferably includes a lower lip 62 that extends downwardly into the hole in the ground, and an upper lip 56 that serves as an outer perimeter or boundary for the bottom or base 58 of the vase 28. A vase support tube having a threaded mouth at one end may be inserted into a centrally positioned hole in the rubber base guard. The threaded mouth of the vase support tube may be screwed onto a threaded portion on the bottom of the vase, and the bottom of the vase support tube fits snugly into the hole in the rubber base guard. The chain extends downwardly from within the vase, through the vase support tube and into the hole, to be secured to the spring, which is attached to the clamp and the spike.

These arrangements provide several benefits. First, they provides a secure manner for attaching the floral vase anchor to the vase, to keep the vase anchor and the floral arrangement from inadvertently becoming dislodged from the vase. Secondly, this arrangement allows the vase to be secured to the ground or to a preformed monument, to prevent the vase itself from being knocked over or stolen. Additionally, the rubber base guard allows some flexibility in the system, so that if the apparatus is used in a cemetery, for instance, a lawn mower may hit the vase and temporarily make the vase lean in one direction due to the force of the mower, but the flexibility of the rubber base guard, together with the spring action of the spring, allows the vase to pop back to the upright position after the mower is no longer in contact with the vase.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A floral vase anchor comprising:

a tri-planar strip of generally rigid material, wherein said strip includes a central portion having an upper end and a lower end;

an upper portion extending from said upper end of said central portion at an obtuse angle;

a lower portion extending from said lower end of said central portion at an obtuse angle;

each said upper portion and said lower portion including a floral insert slot, each slot extending through a top edge and a bottom edge of the side tri-planar strip;

said central portion including a series of notches along side edges thereof; and wherein said central portion defines a threaded hole for receiving a tension screw.

2. The floral vase anchor set forth in claim 1, wherein said upper portion also includes indentations on either side thereof adjacent a mouth of said floral insert slot.

3. The floral vase anchor set forth in claim 1, further including a securing mechanism that is adapted to be attached to said floral vase anchor, and which may further be attached to a vase, in order to secure said floral vase anchor to said vase.

4. The floral vase anchor set forth in claim 3, wherein said securing mechanism includes a chain member.

5. The floral vase anchor set forth in claim 3, wherein said securing mechanism includes a hook member having a hook at one end and an eyelet at another end, so that said hook may engage a vase, and said eyelet may engage said tension screw.

6. The floral vase anchor set forth in claim 1, further including a securing mechanism that is adapted to be attached to said floral vase anchor, and which may further be attached to a ground surface, in order to secure said floral vase anchor and said vase to the ground.

7. The floral vase anchor set forth in claim 6, wherein said securing mechanism includes a chain member operatively connected to a stake member that is driven into the ground.

8. The floral vase anchor set forth in claim 7, wherein said securing mechanism includes a rubber base guard that fits into a hole in said ground, and which is adapted to receive said vase.

9. The floral vase anchor set forth in claim 8, further including a spring member operatively attached between said stake member and said chain member.

* * * * *